US007029034B2

(12) United States Patent
Newell

(10) Patent No.: US 7,029,034 B2
(45) Date of Patent: Apr. 18, 2006

(54) CALENDAR KIT AND APPARATUS FOR BEHAVIOR MODIFICATION AND A METHOD FOR USING THE SAME

(76) Inventor: Patricia M. Newell, 638 Prairie Ave., Wilmette, IL (US) 60091

( * ) Notice: Subject to any disclaimer, the term of this patent is extended or adjusted under 35 U.S.C. 154(b) by 260 days.

(21) Appl. No.: 10/008,006

(22) Filed: Nov. 8, 2001

(65) Prior Publication Data

US 2002/0074792 A1 Jun. 20, 2002

Related U.S. Application Data

(60) Provisional application No. 60/247,261, filed on Nov. 9, 2000.

(51) Int. Cl.
*B42D 5/04* (2006.01)

(52) U.S. Cl. ..... 283/2; 283/3; 283/4; 283/61; 283/62; 283/63.1; 281/2; 281/3.1; 281/5; 281/15.1; 281/22; 281/29; 281/27.1; 281/36; 281/37; 281/38; 281/51; 40/107; 40/109; 40/122; 40/335; D19/20; D19/21; D19/22; D19/23; D19/24; D19/25; D19/26; 368/28; 434/304

(58) Field of Classification Search ..... 40/107, 40/335, 109, 122; 281/2, 3.1, 5, 15.1, 22, 281/29, 27.1, 36, 37, 38, 51; 283/2, 61, 62, 283/63.1, 3, 4; D19/20, 21, 22, 23, 26, 24, D19/25; 368/28; 434/304
See application file for complete search history.

(56) References Cited

U.S. PATENT DOCUMENTS 2,354,589 A 7/1944 Georgi
3,605,306 A * 9/1971 Diambra et al. ..... 40/107
3,911,606 A 10/1975 Hunkins
3,936,384 A 2/1976 Williams
4,090,301 A 5/1978 Della Monica
4,201,405 A 5/1980 Rannenberg
4,346,697 A 8/1982 Cohen
D269,976 S * 8/1983 Szigeti ..... D19/20
4,776,799 A 10/1988 Walsh
4,798,402 A 1/1989 Pazicni
4,858,350 A 8/1989 Malarchik
4,863,193 A * 9/1989 Keshani ..... 283/2
4,905,388 A 3/1990 Sinkow
4,909,740 A 3/1990 Rankin
5,016,917 A 5/1991 Dubner et al.
5,123,191 A * 6/1992 Kim ..... 40/358
5,195,262 A * 3/1993 Roane ..... 40/109

(Continued)

*Primary Examiner*—Boyer Ashley
*Assistant Examiner*—Mark Henderson
(74) *Attorney, Agent, or Firm*—Patents & TMS, P.C.

(57) ABSTRACT

A calendar is provided for behavior modification as well as a method for using the same. The calendar has calendar sheets and informational sheets. The calendar has objectives sections, data collection sections, analysis sections, non-date pages and/or detachable pages for use by an individual. The calendar may be customized and/or pre-designed for an individual or by the individual. In use, the behavior information may be recorded on the calendar sheet. Information associated with daily, weekly, and/or monthly behavior may be recorded. The information may include weekly and/or monthly averages and/or summations, delta calculations, and/or minimum/maximum data. The calendar may be adapted to measure or track indicators, such as, for example, developmental progress, caloric intake, amount and type of exercise, amount of fat, sodium or sugar, amount of cigarettes smoked, blood pressure measurements, weight gain or the like. A bottom space may also be provided to record monthly goals and/or objectives.

20 Claims, 6 Drawing Sheets

U.S. PATENT DOCUMENTS 5,207,580 A 5/1993 Stretcher
5,261,702 A 11/1993 Mayfield
5,280,961 A * 1/1994 Rohloff ..... 283/2
5,313,722 A 5/1994 Ackerman
5,316,342 A * 5/1994 Almo ..... 283/2
5,339,546 A * 8/1994 Rahwan ..... 40/107
5,393,100 A 2/1995 Coe
5,412,886 A * 5/1995 Quinn ..... 40/119
5,431,450 A * 7/1995 Coleman ..... 283/62
5,443,387 A 8/1995 Mortemard de Boisse
5,496,070 A 3/1996 Thompson
5,573,404 A * 11/1996 Stawski, II ..... 434/238
5,636,870 A 6/1997 Enhorning
5,697,647 A * 12/1997 Ruescas ..... 283/3
5,715,618 A * 2/1998 Whang ..... 40/119
5,759,043 A 6/1998 Craig
5,810,395 A * 9/1998 Morgan ..... 283/70
5,813,539 A * 9/1998 DePalma ..... 206/459.1
5,934,707 A * 8/1999 Johnson ..... 283/2
5,984,361 A * 11/1999 Westerman et al. ..... 281/22
5,984,368 A 11/1999 Cain
6,158,597 A * 12/2000 McDermott ..... 211/45
6,217,076 B1 * 4/2001 Howard et al. ..... 283/2
6,324,777 B1 * 12/2001 Ngan ..... 40/107
D480,420 S * 10/2003 McCormack ..... D19/20
2002/0074792 A1 * 6/2002 Newell ..... 283/2
2003/0224336 A1 * 12/2003 Jackson ..... 434/238

* cited by examiner

CALENDAR KIT AND APPARATUS FOR BEHAVIOR MODIFICATION AND A METHOD FOR USING THE SAME

This application claims the benefit of U.S. Provisional Application Ser. No.: 60/247,261, filed Nov. 9, 2000.

BACKGROUND OF THE INVENTION

The present invention generally relates to a calendar kit and apparatus for behavior modification and a method for using the same. More specifically, the present invention provides a calendar kit having monthly calendar sheets and information relating to behavior modification, particularly as the behavior relates to health of an individual.

Of course, calendars that aid in a regimen are generally known. For example, U.S. Pat. No. 5,313,722 to Ackerman discloses a system wherein a woman records periodic health events on a calendar and may then analyze these events to predict health events. A temporary twelve month record is marked on the calendar.

Further, pregnancy calendars are generally known. Typically the format of known pregnancy calendars are synchronized to traditional calendars and, therefore, are labeled without any correlation to the actual month of the year, e.g. month one, month two, etc.

Another example of a calendar that aids in a regimen is disclosed in U.S. Pat. No. 5,207,580 to Stretcher. Stretcher discloses a system for tailoring a health-related behavior change. Collected data is entered into a computer algorithm that uses the data to create tailored behavior change and adherence feedback. The computer algorithm produces feedback in the form of single month calendar sheets or a series of date book pages containing specific instructions and advice associated with the history and patterns of the existing health-related behavior. Further, Stretcher requires computer analysis and data collection to create the calendar.

Yet another example of a calendar that aids in a regimen is disclosed in U.S. Pat. No. 5,016,917 to Dubner et al. Dubner et al. disclose a calendar for correlating the time periods of a predetermined regimen with calendar time periods in which the regimen is performed. Space is provided adjacent to each calendar day on which the individual performing his regimen may record progress or other significant events. A second page adjacent the calendar page contains additional information relevant to the regimen.

A need, therefore, exists for a kit, apparatus and method for a calendar with objectives, data collection, analysis sections, non-date pages and detachable pages for use by an individual that may be customized and/or pre-designed for that individual for a particular regimen that may be implemented by an individual.

SUMMARY OF THE INVENTION

The present invention generally relates to a calendar kit and apparatus for behavior modification and a method for using the same. More specifically, the present invention provides a calendar kit having monthly calendar sheets and information relating to behavior modification. The calendar kit includes objective sections, data collection sections, analysis sections, non-date pages and detachable pages for use by an individual. The calendar kit of the present invention may be customized and/or pre-designed for an individual or by the individual.

To this end, in an embodiment of the present invention, a calendar is provided. The calendar has a calendar sheet, a plurality of boxes, an information sheet, an attachment means and a plurality of spaces. The plurality of boxes are defined by a plurality of vertical columns corresponding to a plurality of days and a plurality of horizontal rows. Each of the plurality of boxes defines a time period. The attachment means secures the information sheet to the calendar sheet wherein the calendar sheet is removably attached such that the calendar sheet may be detached from the information sheet. The plurality of spaces are on the calendar sheet and are located next to each one of the plurality of horizontal rows wherein each of the plurality of spaces receives information related to each of the plurality of boxes in each one of the plurality of rows.

In another embodiment, the calendar has a second space on the calendar sheet wherein the second space receives information related to the information recorded in the plurality of spaces.

In another embodiment, the calendar has a second box within each of the plurality of boxes wherein data is entered in the second box.

In another embodiment, the calendar has an attachment device for attaching the calendar to a surface.

In another embodiment, the calendar has a calculator associated with the calendar sheet.

In another embodiment, the calendar has a writing utensil associated with the calendar sheet.

In another embodiment, the calendar has a pill dispenser associated with the calendar sheet.

In another embodiment, the calendar has a plastic housing associated with the calendar sheet.

In another embodiment of the present invention, a method for recording information is provided. The method comprises the steps of: providing a calendar sheet; providing boxes on the calendar sheet wherein the boxes set forth sequential days within a defined period and further wherein a plurality of sequential boxes define a row; recording information in at least one of the boxes; providing a data entry area adjacent to the row; and recording information in the data entry area adjacent to the row indicative of a calculation of the information recorded in the boxes in the row.

In another embodiment, the method for recording information further comprises the step of providing a plurality of rows defined by the plurality of sequential boxes.

In another embodiment, the method for recording information further comprises the step of providing a plurality of data entry areas adjacent to the plurality of rows.

In another embodiment, the method for recording information further comprises the step of recording information in a second data entry area indicative of a calculation of the information recorded in the plurality of data entry areas adjacent to the plurality of rows.

In another embodiment, the method for recording information further comprises the step of providing an informational sheet associated with the calendar sheet.

In another embodiment, the method for recording information further comprises the step of attaching the informational sheet to the calendar sheet.

In another embodiment, the method for recording information further comprises the step of providing a back cover associated with the calendar sheet.

In another embodiment, the method for recording information further comprises the step of providing a fastener on the back cover.

In another embodiment of the present invention, a calendar kit is provided. The calendar kit has a back cover, a calendar sheet, a data sheet, means for removably attaching the data sheet and the calendar sheet to the back cover, and means for recording information associated with the data sheet on the calendar sheet. The calendar sheet has a plurality of rows defined by boxes wherein each of the boxes define a time period and further wherein a plurality of spaces on the calendar sheet are located next to each one of the plurality of horizontal rows.

In an embodiment, the calendar kit has a hanging means attached to the back cover.

In an embodiment, the calendar kit has a writing utensil associated with the calendar sheet.

In an embodiment, the calendar kit has a calculator associated with the calendar sheet.

In an embodiment, the calendar kit has a pill dispenser associated with the calendar sheet.

In an embodiment, the calendar kit has a housing for the calendar sheet.

It is, therefore, an advantage of the present invention to provide a calendar, a calendar kit for behavior modification and a method for using the same wherein errors associated with the failure of a planned action to be completed as intended or the use of a wrong plan to achieve an aim may be reduced by use of the calendar.

Another advantage of the present invention is to provide a calendar, a calendar kit for behavior modification and a method for using the same wherein an individual may record goals and monitor and evaluate the progress of his or her goals.

Another advantage of the present invention is to provide a calendar, a calendar kit for behavior modification and a method for using the same wherein an individual may collect and record data which may be evaluated for potential problems, progress and/or patterns.

Yet another advantage of the present invention is to provide a calendar, a calendar kit for behavior modification and a method for using the same wherein informational and motivational non-date pages are provided to encourage, support, and educated an individual.

Further, an advantage of the present invention is to provide a calendar, a calendar kit for behavior modification and a method for using the same wherein a health care professional works with a patient to empower and/or enable the patient to work towards a health objective.

Still further, an advantage of the present invention is to provide a calendar, a calendar kit for behavior modification and a method for using the same wherein a user may track health objectives, including, but not limited to weight control, hyperlipidemia, heart disease, diabetes, chronic pain, addiction, smoking, hypertension and pregnancy.

Another advantage of the present invention is to provide a calendar, a calendar kit for behavior modification and a method for using the same wherein a user is provided daily data boxes for recording information wherein the boxes create a visual aid to identify daily progress and/or trends.

Yet another advantage of the present invention is to provide a calendar, a calendar kit for behavior modification and a method for using the same wherein a user is provided weekly and monthly data spaces that may be used to summarize daily information in the form of averages, minimum/maximum data, summary data, delta measurements and the like wherein the weekly and monthly data spaces create a visual aid to identify weekly and monthly progress and/or trends.

Further, an advantage of the present invention is to provide a calendar, a calendar kit for behavior modification and a method for using the same wherein detachable pages are used such that information pages may be paired with corresponding monthly calendar pages.

Still further, an advantage of the present invention is to provide a calendar, a calendar kit for behavior modification and a method for using the same wherein a self-help calendar with instructions, objectives, and methods to modify and/or analyze objectives are provided.

Another advantage of the present invention is to provide a calendar, a calendar kit for behavior modification and a method for using the same wherein the calendar may be adapted to several sizes such as, for example, sized to fit a classroom wall or sized to fit a pocket of an individual.

Yet another advantage of the present invention is to provide a calendar, a calendar kit for behavior modification and a method for using the same wherein the calendar is provided with increased print size to aid the visually impaired.

Further, an advantage of the present invention is to provide a calendar, a calendar kit for behavior modification and a method for using the same wherein the calendar is provided with a plastic sheet having a pocket allowing for placement of additional month related information.

Still further, an advantage of the present invention is to provide a calendar, a calendar kit for behavior modification and a method for using the same wherein the calendar is provided with detachable/re-attachable pages for use in individualizing the calendar.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a calendar kit, an apparatus for behavior modification and a method for using the same. More specifically, the present invention provides a calendar kit having calendar sheets and/or regimen sheets for one or more of the calendar sheets. To this end, the calendar kit may include objectives sections, data collection sections, analysis sections, non-date pages and/or detachable/re-attachable pages for use by an individual. The calendar kit of the present invention may be customized and/or pre-designed for an individual or by the individual.

The calendar kit of the present invention may provide a motivational, educational and/or documentational aide to health modification in a convenient and/or reliable calendar format. The calendar kit may be used in conjunction with a program or may be used on its own with references given to comprehensive and/or specific ideas. The calendar kit is not intended to necessarily substitute for a comprehensive program, but may be used as a complementary aid. The calendar may be adaptable to a specific medical condition, such as, for example, diabetes, high blood pressure, heart disease, arthritis, or the like. The calendar may also be adaptable for measuring several indicators of health progress, such as, for example, weight, calorie intake, amount and type of exercise, amount of fat, sodium and sugar, amount of cigarettes smoked, blood pressure measurements, or the like. The calendar may further be adaptable for one or more people in a household, such as, for example, a husband and wife.

The measurements of health progress may be recorded daily, weekly, etc., but, in a preferred embodiment, a weekly and/or monthly average is used for a reliable and objective indication of changes and/or trends. The measurements may be recorded once per day and may be used to compute average weekly figures. Or, measurements may be recorded once a week and used to compute average monthly figures. Further, the measurements may be in the form of averages, minimum/maximum data, summary data, delta measurements and the like wherein the weekly and monthly figures create a visual aid to identify weekly and monthly progress and/or trends. While the invention has been and will be described with respect to weeks, months and/or years, it should be understood that the calendar of the present invention may be adapted for any predetermined and/or periodic length of time.

Figure 1:
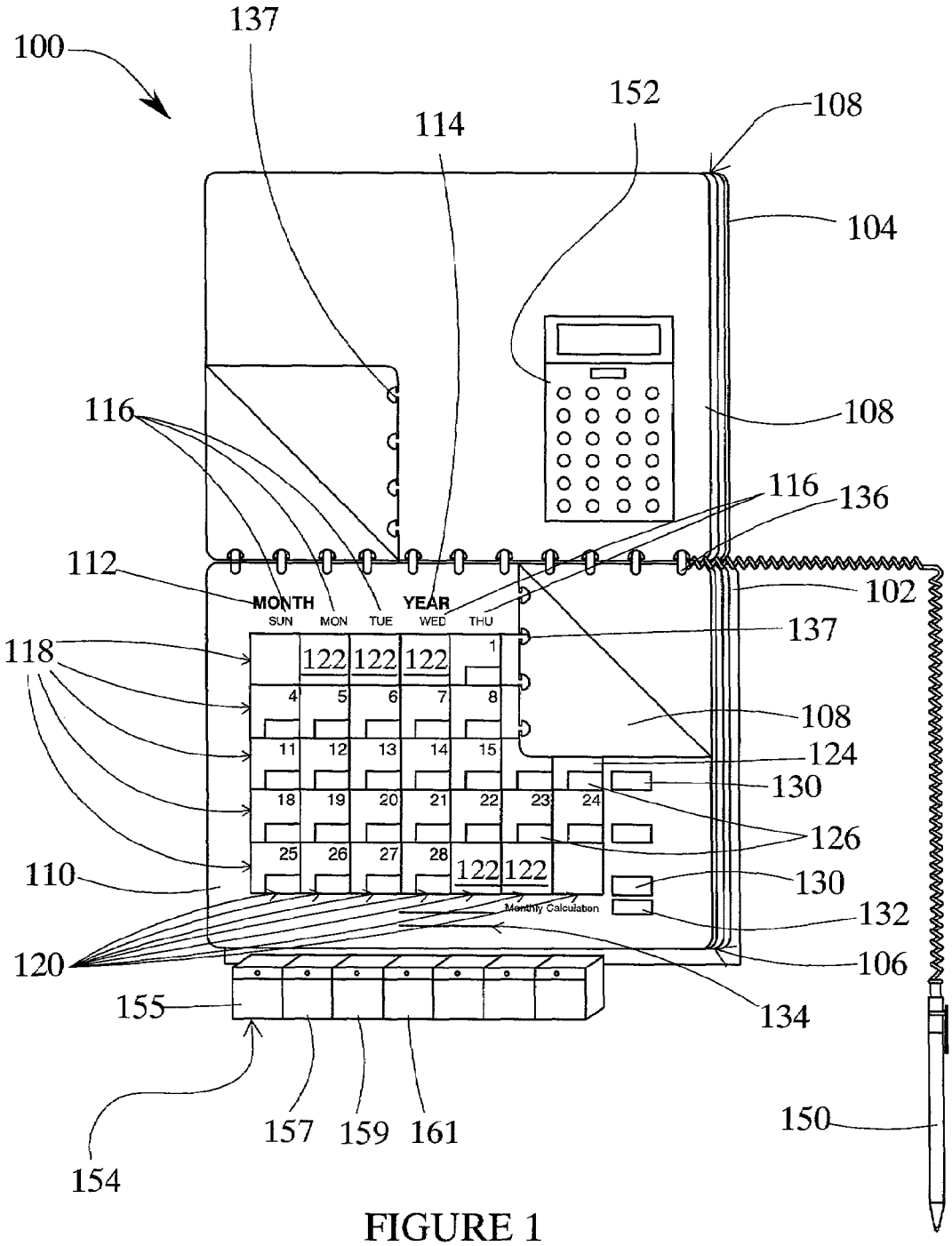
FIG. 1 illustrates a perspective view of a calendar in an embodiment of the present invention.

Referring now to FIG. 1 wherein like numerals refer to like parts, a calendar 100 of the present invention is generally illustrated. The calendar 100 may include a back cover 102 and a front cover 104. Between the back cover 102 and the front cover 104 may be positioned monthly calendars 106 wherein each of the monthly calendars 106 is stacked upon each other. Between the monthly calendars 106 and the front cover 104 may be positioned data sheets 108.

The data sheets 108 may include information associated with a particular regimen. The regimen may be associated with the appropriate month, day and week in which the particular regimen may begin or end or otherwise require a particular act or function of an individual. Each one of the data sheets 108 may include a sequential regimen associated with at least one of the monthly calendars 106. The data sheets 108 and the monthly calendars 106 may be attached in face-to-face or opposed relation so that the regimen of the data sheets 108 may be associated with the appropriate one of the monthly calendars 106.

Further, the data sheets 108 may include information and/or motivational strategies, such as, for example, benefits and/or suggestions for health improvement, specific medical conditions, or the like. The data sheets 108 may also include references to books, recipes, programs, support groups, web sites, and/or month-specific information. The data sheets 108 of the calendar 100 may include information including instructions, such as, for example, showing the user how to average data. The user may average data such as, for example, the user's body weight recorded on a daily basis. The following equation is an example of an equation that may be included on the calendar 100 to instruct the user to average data:

$$\text{Average Body Weight} = \frac{\text{The sum of daily recorded body weight}}{\text{Number of Days Body Weight Recorded}}$$

Referring again to FIG. 1, the monthly calendars 106 may have a top monthly calendar 110. The top monthly calendar 110 may include a month indicia 112, a year indicia 114 and day of the week indicia 116. The top monthly calendar 110 may further include, for example, thirty-five boxes 122 that may be arranged in five successive rows 118 and seven columns 120. The seven columns 120 may each have a day of the week indicia 116. In an embodiment, the seven columns 120 may set forth sequential days of the week, preferably beginning with the day of Sunday.

The boxes 122 may represent each day of the month. Each one of the boxes 122 may have a number indicia 124 indicating the day of the month. Each one of the boxes 122 may have at least one designated area 126 for recording data. The data may include information such as caloric intake, amount and type of exercise, amount of fat, sodium, sugar, amount of cigarettes smoked, blood pressure measurements, weight, etc. The data may also be useful for the health care provider and may serve as an additional tool that may be used to treat one or more medical conditions.

A weekly data area 130 may be provided on the top monthly calendar 110 next to the seven columns 120 wherein each weekly data area 130 may correspond with one of each of the successive rows 118. The weekly data area 130 may allow a user to enter data on the calendar 100 relating to, for example, weekly averages of body weight gain/loss, weekly amount of cigarettes smoked, or the like.

A monthly data area 132 may be provided on the top monthly calendar 110 below the weekly data area 130. The monthly data area 132 may allow for the entering of data by the user of the calendar 100, such as, for example, a monthly average calculation of body weight, a monthly measurement of total miles run, or the like.

Figure 2:
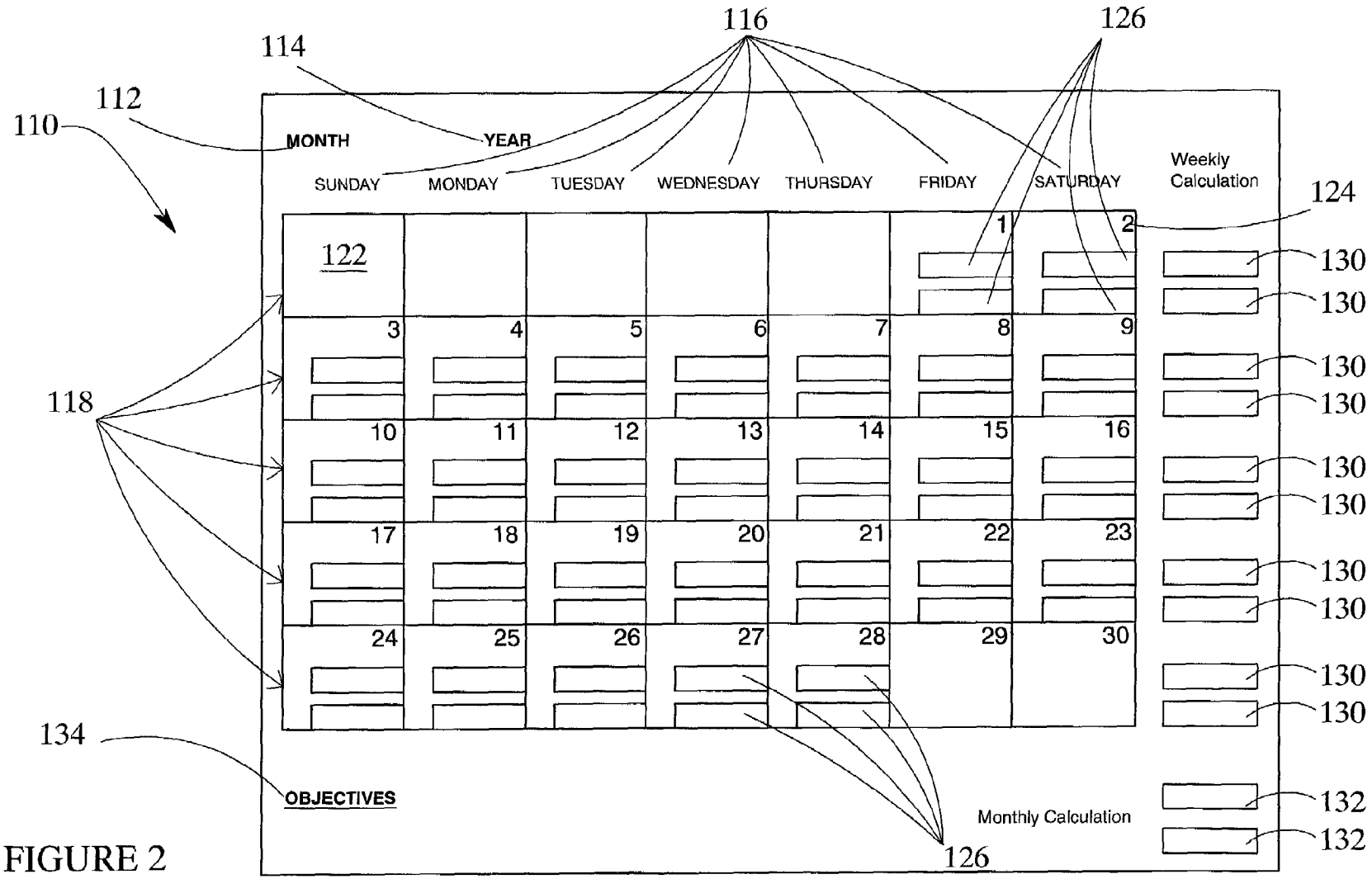
FIG. 2 illustrates a top view of a calendar in an embodiment of the present invention.

Referring now to FIG. 2, in another embodiment of the present invention, each one of the boxes 122 may have more than one designated area 126 for data. Further, more than one weekly data area 130 may correspond with one of each of the successive rows 118, and the top monthly calendar 110 may have more than one monthly data area 132.

The calendar 110 having more than one of the designated area 126, the weekly data area 130, and/or monthly data area 132 may allow for a user to record data with respect to more than one type of regimen. For example, the user may record daily caloric intake and daily body weight measurements in each of the respective designated areas 126 in one of the boxes 122 for each day of the month. The user may also record the average caloric intake for the week and the average daily body weight measurements for the week in the respective weekly data area 130. Further, the user may record the average daily caloric intake for the month and the average daily body weight measurements for the month in the respective monthly data area 132.

Alternatively, the calendar 110 having more than one of the designated area 126, the weekly data area 130, and the monthly data area 132 may allow for multiple users. For example, two persons, such as, for example, a husband and a wife, may each record amount of miles run in a given day in a respective one of the designated areas 126. The husband and the wife, for example, may each record the total amount of miles run per week in a respective one of the weekly data areas 130. The husband and the wife may each record the total amount of miles run per month in a respective monthly data area 132. As a result, the husband and the wife may each track the amount of miles run daily, weekly, and/or monthly using the same calendar 110. Of course, other health related objectives may be recorded as previously discussed. Further, if multiple persons are using the calendar to record data, each person may record distinct, unrelated data or related data, such as discussed above with respect to, for example, number of miles run by each individual.

Figure 3:
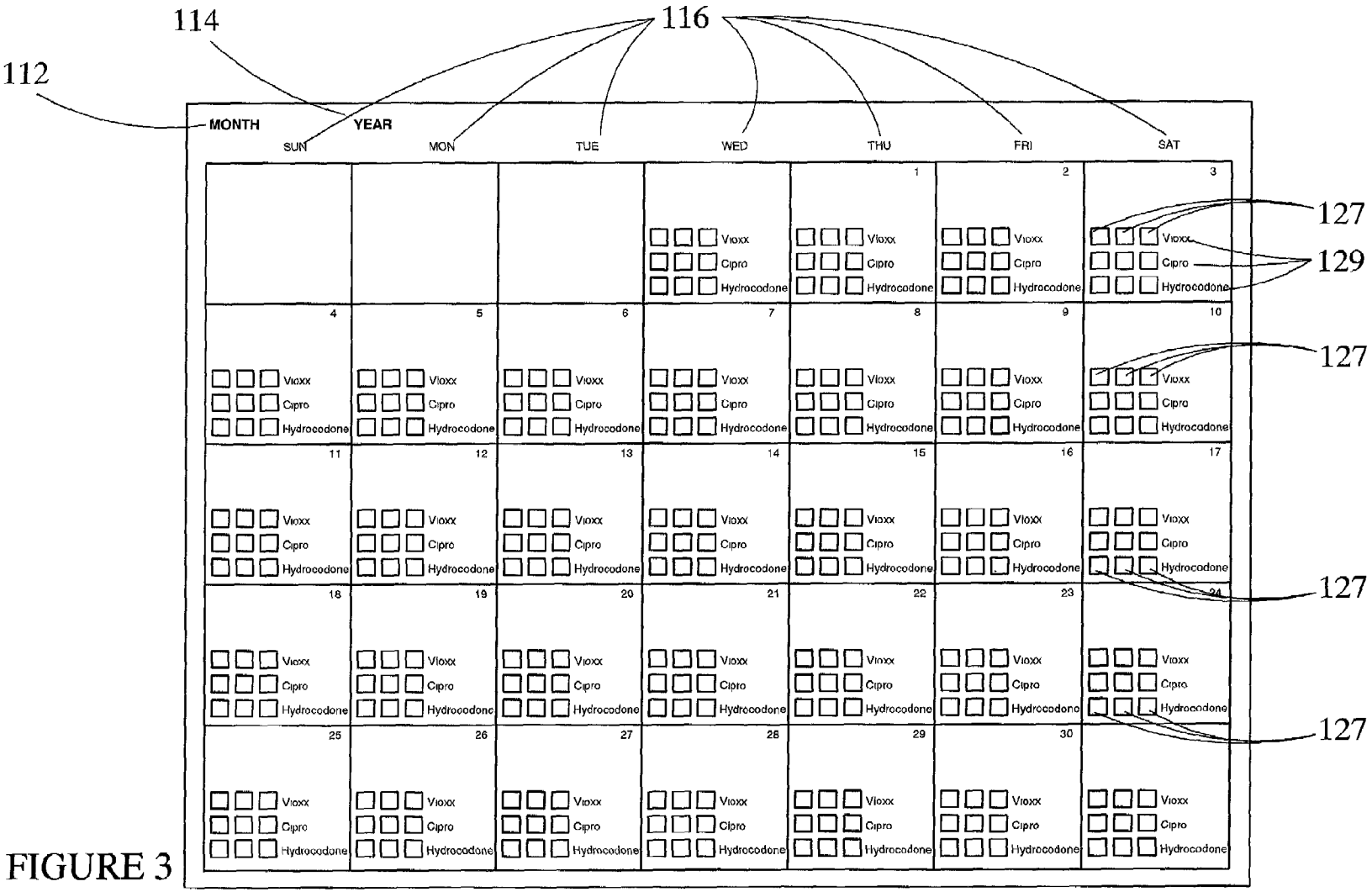
FIG. 3 illustrates a top view of a calendar in an embodiment of the present invention.

As shown in FIG. 3, each one of the boxes 122 may have multiple designated areas 127 for data with accompanying text 129 to distinguish the multiple designated areas 127. For example, a user may wish to track the medication that he/she must take daily. The user may enter the medication that he/she must take as accompanying text 129. For example, a user taking pain medication, antibiotics, and blood pressure medication, may enter the names of each of those medications as the accompanying text 129. The user may then check one of the multiple designated areas 127 each time that he/she takes his/her pain medication, antibiotics, and/or blood pressure medication, to track how many daily doses that he/she consumed. The monthly calendar 106, as shown in FIG. 3, may be computer generated by, for example, a pharmacist upon filling a prescription, for use by an individual.

In another example, a user may wish to track daily family chores and/or activities. For example, a user such as a Mother of a family may enter the names of her children, Son and Daughter, as the accompanying text 129 to distinguish the multiple designated areas 127. The Mother may make a check mark in one of the multiple designated areas 127, next to the Son's name in the accompanying text 129 if the Son makes his bed in the morning. The Mother may make a check mark in a second of the multiple designated areas 127 next to the Son's name in the accompanying text 129 if the Son completes his homework. The Mother may make similar marks in one and/or second one of the multiple designated areas 127 next to the Daughter's name in the accompanying text 129 if the Daughter makes her bed and/or completes her homework, respectively. Likewise, health related objectives or other periodically tracked events as set forth throughout the description for the Son and the Daughter may also be entered rather than chores as described above. Further, of course, the Son and/or the Daughter may track their own events.

Referring again to FIGS. 1 and 2, the weekly and monthly average calculations allow the user to take into account normal fluctuations. The weekly and monthly average calculations further provide a more accurate indicator by which to assess and/or to compare changes and trends to evaluate progress and/or re-examine objectives. For example, because a user's body weight may fluctuate day by day, a weekly average may provide a more accurate indicator of body weight. Further, a weekly and/or a monthly average may provide a more accurate indication of total weight gain/loss.

Further, the data sheets 108 and the monthly calendars 106 may be removably attached to the calendar 100 by the use of, for example, rings 136 and perforations 137, adhesive (not shown), or the like. The detachable data sheets 108 may be matched with any one of the monthly calendars 106, and therefore, may follow a sequence that corresponds to the user's commencement of a program. For example, a user may commence and/or correlate the data sheets 108 and the monthly calendars 106 to begin a medication regimen, or the beginning of pregnancy, or the like. For example, one of the data sheets 108 may relate to weight loss and may be attached for use with one of the monthly calendars 106 and later may be removed and re-attached for use with a second one of the monthly calendars 106. Alternatively, one of the data sheets 108 may relate to the first month of pregnancy and may, therefore, be removed and/or placed to correspond to the month that relates to the first month of pregnancy. After the first month of pregnancy, the data sheets 108 relating only to the first month of pregnancy may be removed and discarded.

The detachable data sheets 108 allow the calendar 100 to be individualized to correspond to the beginning of a program, such as, for example, weight loss, any developmental process that does not follow the traditional calendar year, pregnancy, or the like.

Alternatively, each of the data sheets 108 may be integrally constructed with each of the monthly calendars 106. Further, each of the data sheets 108 may be integrally constructed with each of the monthly calendars 106 and may have a cut line (not shown) such that the data sheets 108 may be selectively removed from and/or arranged with the monthly calendars 106, respectively.

With the use of the detachable data sheets 108, in such cases where measurements may be linked to a specific month, for example, the calendar 100 may be adapted with detachable data sheets 108 to allow for the coordination of the event with the specific month. An example where measurements may be linked to a specific month may include, for example, pregnancy, a baby's development, etc.

If the user is following a program specific to a medical condition, e.g. diabetes, high blood pressure, heart disease, obesity, arthritis, etc., the user may determine with his/her doctor or other health care provider how to use the calendar 100 in a manner that may be compatible with their condition and/or to help him/her meet his/her specific objectives. For example, the calendar 100 may be adapted such that each of the weekly data areas 130 may be used to add cumulative measures, e.g. time spent exercising each week.

A bottom space 134 may be provided on the top monthly calendar 110 to record additional data, such as, for example, monthly goals and/or objectives and/or progress notes. The additional data recorded on the bottom space 134 may be used, for example, to re-evaluate what prevented the user from achieving his/her objectives if the user's goal were not met, e.g. 1) Were the objectives too high? 2) Were modifications hard to follow? 3)Was the program too difficult? 4) Did the user experience frustration and/or become unmotivated? 5) Could healthy rewards for specific attainment of sub-objectives help the user to realize his/her goals?

Figure 6:
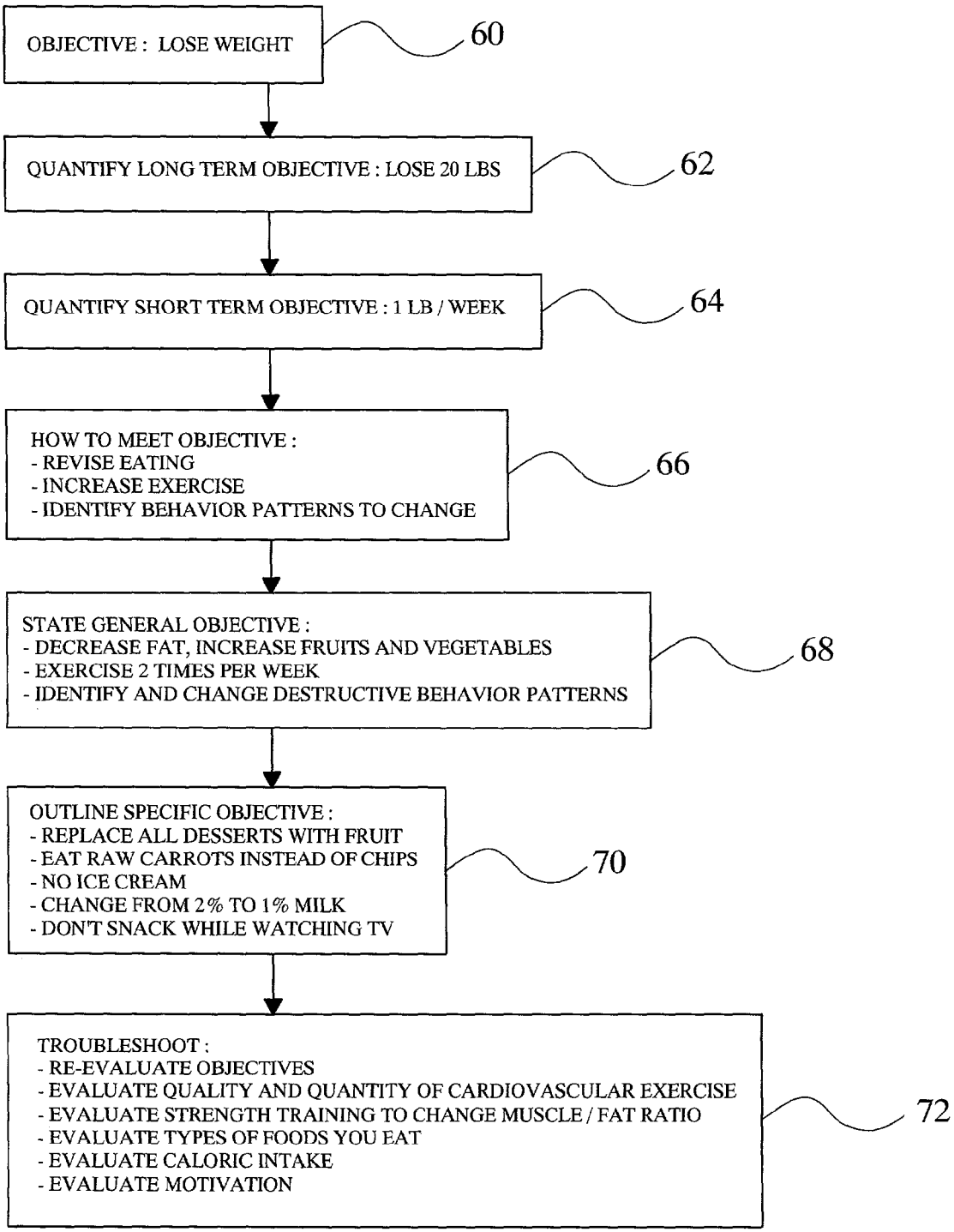
FIG. 6 illustrates a flow chart of a method of identifying and evaluating a health care objective of a calendar in an embodiment of the present invention.

A method for using the bottom space 134, in an embodiment of the present invention, is illustrated in FIG. 6. An individual may record his objective, such as, for example, lose weight via step 60. The individual may then quantify his long term objective, such as, for example, lose twenty pounds, via step 62. The individual may then quantify his short term objective, such as, for example, lose one pound per week, via step 64. The individual may then record how he will meet his long term and/or short term objective, such as, for example, revise eating, increase exercise, and/or identify behavior patterns to change, via step 66. Further, the individual may record general objectives, such as, for example, decrease fat, increase fruit & vegetables, exercise two times per week, and/or identify and change destructive behavior patterns, via step 68. The individual may outline specific objectives, such as, for example, replace all desserts with fruit, eat raw carrots instead of chips, no ice cream, change from 2% to 1% milk, and/or no snacking while watching television, via step 70. Finally, if the individual is not successful in meeting his goals, the individual may troubleshoot via step 72. Troubleshooting may include, for example, re-evaluating objectives, evaluating quality and quantity of cardiovascular exercise, evaluating strength training to change muscle/fat ratio, evaluating types of foods eaten, evaluating caloric intake, and/or evaluating motivation.

Of course, the method illustrated in FIG. 6 is only one example of how to use the bottom space 134 of the monthly calendars 106. It is an object of the present invention that the bottom space 134 may be used to record any information useful to meeting the goals or purpose of the individual using the calendar 100.

Referring again to FIGS. 1 and 2, information recorded on the designated area 126, the weekly data area 130, the monthly data area 132 and/or the bottom space 134 may allow the user to clearly identify his/her objectives. The information recorded on the monthly calendars 106 may also allow the user to see his/her daily, weekly, and monthly progress as his/her progress relates to the objective on the same page. Integration of this information on the monthly calendars 106 may engage the user in planning his/her objectives, recording measurements related to the objectives, and/or evaluating his/her progress in an easily accessible, objective way.

The health care provider may work with the patient prior to starting a health objective. This assistance may provide valuable information for the provider and/or may allow for a collaborative setting of objectives, measuring progress, or the like. The user may, therefore, be encouraged to participate in setting goals, improving patient compliance and/or follow-up. Further, if the monthly calendars 106 are not re-used, they may serve as a historic record for the user.

Still further, the information recorded on the designated area 126, the weekly data area 130, the monthly data area 132 and/or the bottom space 134 may provide valuable data that may be brought with a user to, for example, medical visits to increase the accuracy of the information obtained and/or to document trends, problems, progress, and/or the like. For example, review of the information recorded in the calendar 100 may indicate that blood pressure measurements are consistently elevated on Monday. The user may verify this information by computing the average for each day of the week. Averaging the data to identify patterns may help the user to modify objectives and provide more information to the health care provider. Further, by computing averages, trends that are not readily observable by individual measurement may be identified. For example, weekly weight gain may be disproportionately affected by, for example, weight gain that may have occurred over the weekend.

The data sheets 108 of the calendar 100 may include, but may not be limited to, information about motivational strategies, information about a health condition and/or an objective. For example, the information on the data sheets 108 may include obesity and/or how to lose weight, benefits and/or suggestions for health improvement and/or specific medical conditions, for example, weight loss, exercise, heart disease, diabetes and/or elevated blood pressure. The information on the data sheets 108 may include, but may not be limited to, references to books, recipes, programs, support groups, websites, and month-specific information related to a diet and/or exercise program, for example.

Figure 4B:
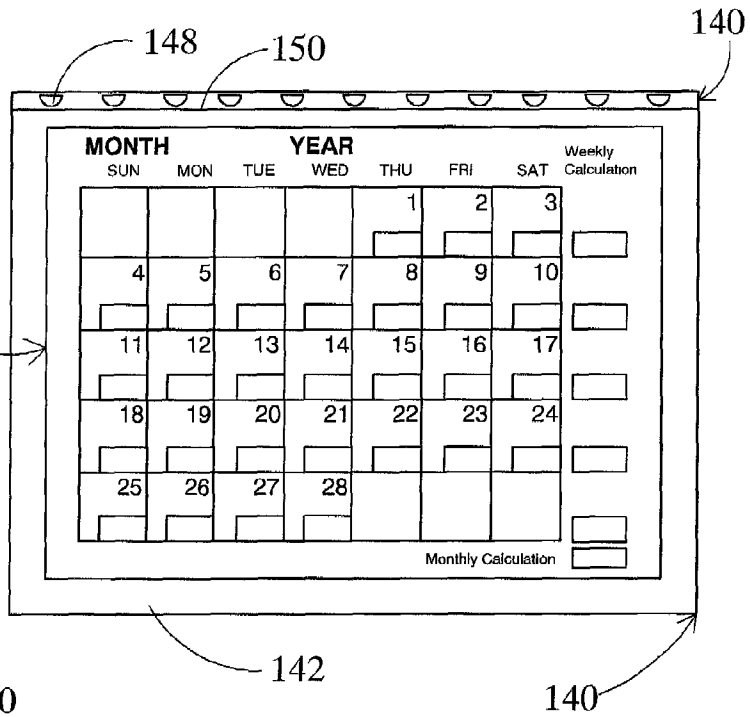
FIG. 4B illustrate a top view of a calendar in an embodiment of the present invention.
Figure 4A:
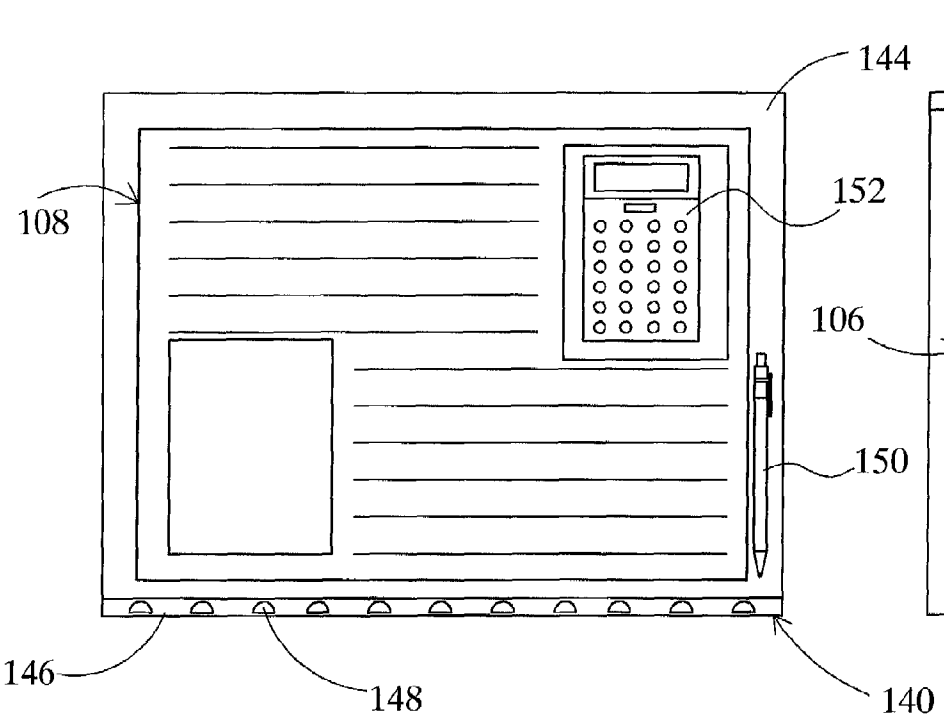
FIG. 4A illustrates a top view of an information page in an embodiment of the present invention.

Referring now to FIGS. 4A and 4B, one of the monthly calendars 106 and one of the data sheets 108 may be housed in, for example, a plastic sheet 140 in an embodiment of the present invention. One of the monthly calendars 106 may be visually displayed through a front side 142 of the plastic sheet 140. One of each of the data sheets 108 may be displayed through a back side 144 of the plastic sheet 140. The plastic sheet 140 may have an attachment strip 146 such that the plastic sheet 140 may be attached to the front cover 104 and the back cover 102 of the calendar 100. Further, the plastic sheet 140 may have a pocket (not shown) or a cover with an opening (not shown) allowing for placement of additional month related information, such as, for example, physical therapy appointments. The attachment means may include holes 148 for removable attachment to rings 136 (shown in FIG. 1). Additionally, the attachment means may include an adhesive (not shown), openings 137 (shown in FIG. 1), or the like.

Of course, the monthly calendars 106 and the data sheets 108 may be constructed of paper such that data written on the data sheets 108 and/or monthly calendar 106 may be permanently recorded.

Referring again to FIG. 1, one of the openings 137 of one of the data sheets 108 may fit around one of the rings 136 such that the one of the data sheets 108 is removably secured to at least one of the rings 136. Multiple openings 137 may fit about multiple rings 136 such that one of the data sheets 108 is removably secured to the calendar 100. Force may be applied by an individual to one of the data sheets 108 such that the data sheets 108 may be removed from the rings 136. FIG. 1 illustrates partial removal of one of the data sheets 108 from the rings 136 of the calendar 100. Openings 137 on the monthly calendars 106 may allow for repeated removal and replacement of the monthly calendars 106 in the same manner as the data sheets 108.

In another embodiment of the present invention, the data sheets 108 and/or the monthly calendars 106 may be laminated rather than placed in the sheets 140. The laminated sheet may incorporate openings to secure the sheets to the rings 136 as previously described. A writing utensil 150 may be attached to the calendar 100 (as shown in FIGS. 1 and 4A) to write on the laminated monthly calendars 106 and/or the plastic sleeve 140 (shown in FIGS. 4A and 4B). The markings by the writing utensil 150 may be erasable such that the plastic sleeve 140 and/or the laminated monthly calendars 106 may be used again.

Figure 5:
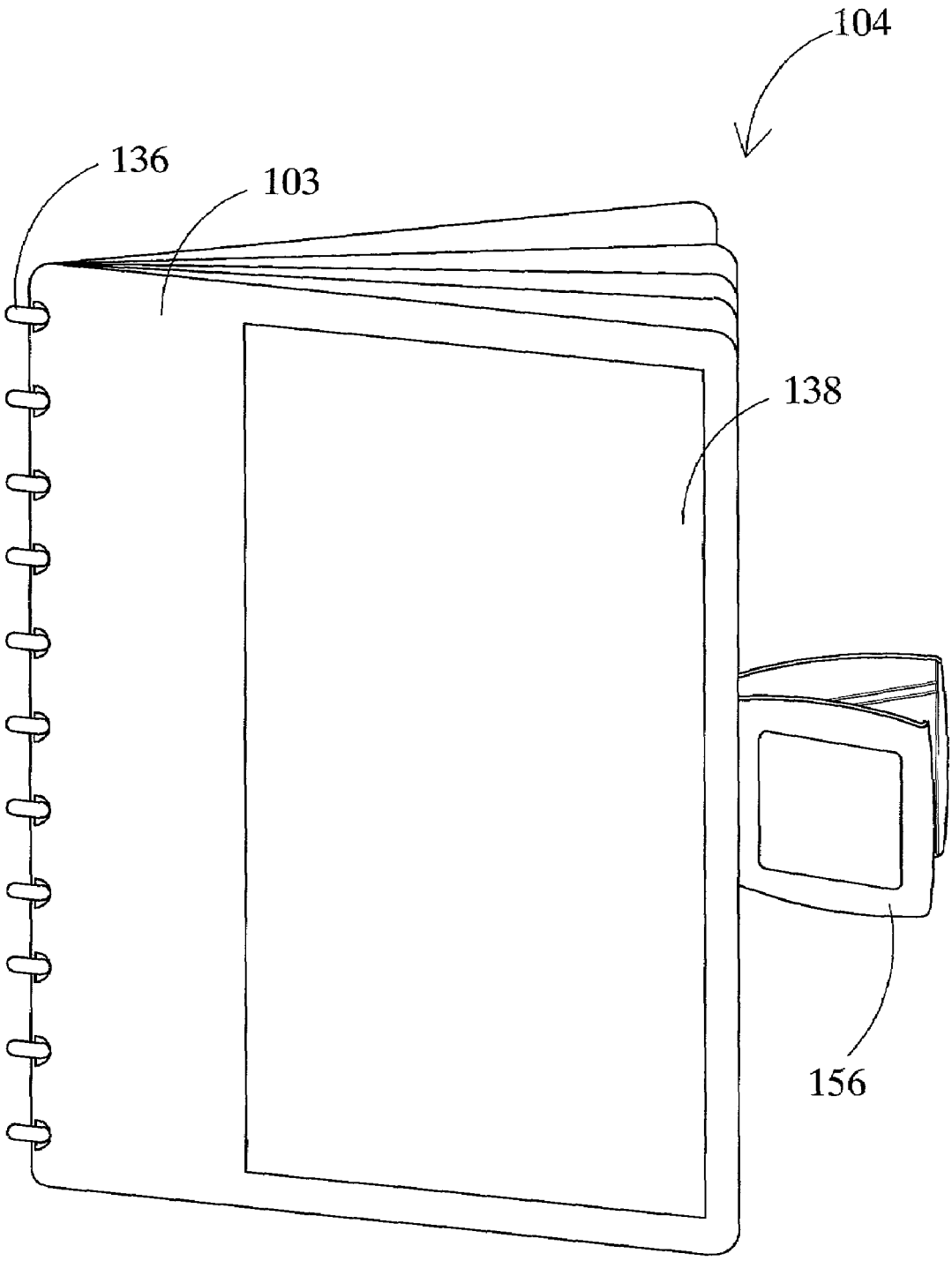
FIG. 5 illustrates a perspective view of a back cover of a calendar in an embodiment of the present invention.

Referring now to FIG. 5, a back side 103 of the front cover 104 is illustrated. In operation of the calendar 100, the calendar 100 may be hung on a wall by means of a hook (not shown), nail (not shown), clip 156, magnet 138, or the like. Referring again to FIGS. 4A and 4B, to display the next succeeding month, which may then be visible through, for example, the plastic sheet 140, the top monthly calendar 110 may be removed from the calendar 100. Alternatively, the top monthly calendar 110 may be rotated upward and may be attached to the front cover 104 to expose the back 144 of the plastic sheet 140 of the top monthly calendar 110 and to expose the front side 144 of the plastic sheet 140. Any number of the plastic sheets 140 may be used to accommodate each of the data sheets 108 and/or each of the monthly calendars 106. Accordingly, each of the data sheets 108 exposed through the back 144 of the plastic sheet 140 may correspond to each of the monthly calendars 106 exposed through the front 144 of the next plastic sheet 140.

The calendar 100 of the present invention may be large, such as, for example, sized to fit a classroom wall, or may be small, such as, for example, sized to fit a pocket of an individual. Further, the calendar of the present invention may have increased print and/or image size to aid the visually impaired (not shown).

Still further, the calendar of the present invention may include an attached calculator 152 and/or a pill dispenser 154 (as shown in FIGS. 1 and 4A). The calculator 152 may assist the individual with computing desired calculation, such as, for example, weekly and/or monthly averages. The pill dispenser 154 may hold, for example, specific medications, such as pills, requiring ingestion by a particular individual on a given day. The pill dispenser 154 may include multiple compartments for each day of the week. For example, an individual may place his or her medication for Monday in a first compartment 155, medication for Tuesday in a second compartment 157, medication for Wednesday in a third compartment 159, and so on. Alternatively, an individual may place one type of medication and/or pill, such as, for example, pain reliever in the first compartment 155, a second type of medication and/or pill, such as, for example, vitamins in the second compartment 157, and so on.

It should be understood that various changes and modifications to the presently preferred embodiments described herein will be apparent to those skilled in the art. Such changes and modifications may be made without departing from the spirit and scope of the present invention and without diminishing its attendant advantages.

I claim:

1. A calendar for recording information relating to health progress of an individual, the calendar comprising:

a plurality of calendar sheets wherein each of the plurality of calender sheets is uniform in size having a length and a width and further wherein each one of the plurality of calender sheets represents a month of a calendar year;

a plurality of boxes printed on each one of the plurality of calendar sheets wherein each one of the plurality of calendar sheets is defined by seven vertical columns and at least four horizontal rows wherein each of the plurality of boxes represent a day of the month wherein each of the boxes has a designated area which receives a first type of data wherein the first type of data is specific to the day and further wherein each one of the at least four horizontal rows defines a week wherein the first type of data is selected from a group consisting of caloric intake, amount and type of exercise, amount of fat, sodium and sugar consumed, and anatomical measurements;

a plurality of information sheets wherein each of the plurality of information sheets is uniform in size having a length and a width wherein the size of each of the plurality of information sheets is substantially equal to the size of each one of the plurality of calendar sheets and further wherein each of the plurality of information sheets is printed with information relating to and providing instructions with respect to the first type of data of the calendar sheet;

an attachment means for attaching each one of the plurality of information sheets to a corresponding one of each one of the plurality of calendar sheets wherein the calendar sheets and the information sheets are removably attached to the attachment means;

a designated section next to each one of the at least four horizontal rows forming a vertical column of designated sections wherein the designated section corresponding to each one of the at least four horizontal rows receives a second type of data related to the first type of data in each one of the plurality of boxes in each one of the at least four horizontal rows wherein the second type of data is a calculation based on the first type of data wherein the calculation defines a measurement of the health progress of the individual for the week; and a summary section below the vertical row of designated sections wherein the summary section receives a third type of data related to the second type of data in the designated sections and further wherein the third type of data is a calculation defining a measurement of the health progress of the individual.

2. The calendar of claim 1 further comprising:

a second box within each of the plurality of boxes wherein the first type of data is entered in the second box.

3. The calendar of claim 1 further comprising:

an attachment device to attach the calendar to a surface.

4. The calendar of claim 1 further comprising:

an electronic calculator attached to one of the plurality of information sheets.

5. The calendar of claim 1 further comprising:

a writing utensil connected to one of the plurality of information sheets.

6. The calendar of claim 1 further comprising:

a pill dispenser connected to one of the plurality of calendar sheets.

7. The calendar of claim 1 further comprising:

a plastic housing enclosing the plurality of calendar sheets.

8. The calendar of claim 1 further comprising:

large text for viewing by the visually impaired.

9. The calendar of claim 1 further wherein the calendar may be adapted to several sizes.

10. A method for recording information relating to health progress of an individual, the method comprising the steps of:

providing a plurality of calendar sheets wherein each of the plurality of calendar sheets represents a month of a calendar year;

providing boxes on each one of the plurality of calendar sheets wherein each one of the boxes set forth sequential days within a defined period and further wherein seven sequential boxes define one of a plurality of rows and further wherein each one of the plurality of rows defines a week;

recording first information in at least one of the boxes in at least one of the rows of one of the plurality of calendar sheets wherein the first information is specific to one day of one of the plurality of calendar sheets and further wherein the first information is selected from a group consisting of caloric intake, amount and type of exercise, amount of fat, sodium and sugar consumed, and anatomical measurements;

providing one of a plurality of data entry areas adjacent to each one of the Plurality of rows wherein the plurality of data entry areas form a vertical column;

recording second information in at least one of the plurality of data entry areas adjacent to each of the plurality of rows wherein the second information relates to the first information in the boxes of the row adjacent to each one of the plurality of data entry areas and further wherein the second information is a calculation to measure health progress of the individual and further wherein the calculation is selected from a group consisting of an average, a summation and a change measurement; and providing a monthly data area on each of the plurality of calendar sheets wherein the monthly data area receives third information related to the second information in each of the plurality of data entry areas wherein the third information is a calculation defining a measurement of the health progress of the individual for more than one week.

11. The method of claim 10 further comprising the step of:

providing an informational sheet associated with one of the plurality of calendar sheets.

12. The method of claim 10 further comprising the step of:

providing a back cover associated with the plurality of calendar sheet.

13. The method of claim 11 further comprising the step of:

attaching the informational sheet to one of the plurality of calendar sheets.

14. The method of claim 12 further comprising the step of:

providing a fastener on the back cover.

15. A calendar kit for recording information relating to health progress of an individual, the kit comprising:

a back cover;

a plurality of calendar sheets wherein each one of the plurality of calendar sheets represents a month of a calendar year and further wherein each of the plurality of calendar sheets is uniform in size having a length and a width wherein each of the plurality of calendar sheets has a plurality of horizontal rows defined by boxes wherein each of the horizontal rows define a week in a month of the calendar year wherein at least one of the boxes in each of the horizontal rows receives first data selected from a group consisting of caloric intake, amount and type of exercise, amount of fat, sodium and sugar consumed and anatomical measurements and further wherein one of a plurality of designated spaces on the calendar sheet are located next to each one of the plurality of horizontal rows wherein each one of the plurality of designated spaces receives second data relating to the first data in the boxes of the row adjacent to one of the plurality of designated spaces;

a plurality of data sheets wherein each of the plurality of data sheets is uniform in size having a length and a width wherein the size of each of the plurality of data sheets is substantially equal to the size of each one of the plurality of calendar sheets and further wherein each of the plurality of data sheets is printed with a first type of information relating to and providing instructions with respect to the first data of the plurality of calendar sheets;

a summary section below the plurality of designated spaces wherein the summary section receives third data related to the second data in each one of the plurality of designated spaces and further wherein the third data is a calculation defining a measurement of the health progress of the individual for more than one week;

an attaching means connecting the plurality of data sheets and the plurality of calendar sheets to the back cover; and means for removably attaching the plurality of data sheets and the plurality of calendar sheets to the attaching means.

16. The calendar kit of claim 15 further comprising:

a hanging means attached to the back cover.

17. The calendar kit of claim 15 further comprising:

a writing utensil connected to one of the plurality of data sheets.

18. The calendar kit of claim 15 further comprising:

a calculator attached to one of the plurality of data sheets.

19. The calendar kit of claim 15 further comprising:

a pill dispenser attached to the back cover.

20. The calendar kit of claim 15 further comprising:

a housing for the plurality of calendar sheets.

* * * * *